US010262505B1

(12) United States Patent
Gopalakrishna et al.

(10) Patent No.: US 10,262,505 B1
(45) Date of Patent: Apr. 16, 2019

(54) ANTI-SKIMMING SOLUTION

(71) Applicant: CA, INC., Islandia, NY (US)

(72) Inventors: Rajendra Arcot Gopalakrishna, Bangalore (IN); Geoffrey Hird, Cupertino, CA (US)

(73) Assignee: CA, Inc., Austin, TX (US)

( * ) Notice: Subject to any disclaimer, the term of this patent is extended or adjusted under 35 U.S.C. 154(b) by 1232 days.

(21) Appl. No.: 14/095,077

(22) Filed: Dec. 3, 2013

(51) Int. Cl.
*G07F 19/00* (2006.01)

(52) U.S. Cl.
CPC ..... *G07F 19/2055* (2013.01)

(58) Field of Classification Search
CPC ..... G07F 19/00
USPC ..... 705/76
See application file for complete search history.

(56) References Cited

U.S. PATENT DOCUMENTS 8,831,979 B1 * 9/2014 Gerson ..... H04L 63/0421 455/414.3
2005/0055318 A1 * 3/2005 Ziegler ..... G06Q 20/347 705/72
2006/0123465 A1 * 6/2006 Ziegler ..... G06F 21/33 726/2
2006/0136332 A1 * 6/2006 Ziegler ..... G06F 21/31 705/39
2008/0241183 A1 * 10/2008 Palma ..... A61K 47/48038 424/193.1
2009/0200371 A1 * 8/2009 Kean ..... G06F 21/31 235/379
2009/0276347 A1 * 11/2009 Kargman ..... G06Q 20/32 705/35
2012/0303534 A1 * 11/2012 Keller ..... G06Q 30/0205 705/72

* cited by examiner

*Primary Examiner* — Lindsay M Maguire
(74) *Attorney, Agent, or Firm* — Vierra Magen Marcus LLP

(57) ABSTRACT

Methods for securing financial transactions using dynamic PINs without requiring updates to existing banking cards or existing infrastructure at acquiring institutions. The use of a dynamic PIN may be selectively enabled for a subset of banking cards or for a particular banking card when circumstances require use of the dynamic PIN. A dynamic PIN may be required for performing a financial transaction, such as making an online purchase, if an account associated with a banking card has a particular credit limit greater than a threshold or if a suspicious transaction history has been detected (e.g., large out-of-state purchases have recently been made). A dynamic PIN may be required based on a time of day or location associated with the financial transaction (e.g., if the financial transaction is being initiated within a particular foreign country).

15 Claims, 6 Drawing Sheets

Mobile Device 141

ANTI-SKIMMING SOLUTION

BACKGROUND

The present disclosure relates to systems and methods for securing financial transactions and preventing card skimming.

Card skimming refers to the theft of banking card information. Banking cards may include credit cards, debit cards, ATM cards, cash cards, pre-payment cards, and other cards issued to a user by a banking institution or other institution acting to promote financial transactions (e.g., fuel cards for use at gas stations or transit cards for facilitating electronic transit fare payments). Card information may be stolen using various methods such as photocopying receipts or using an electronic card skimming device to swipe and store card numbers and other card information. One approach to preventing card skimming involves the use of user passwords and/or personal identification numbers (PINs). In some cases, a PIN (or PIN code) may be entered by the user of a card when using the card at a card processing terminal. For example, the user may enter a PIN when making a withdrawal from an ATM machine or making a purchase at a point of sale (POS) device or terminal. PINs are typically generated by the card issuer (e.g., a card issuing bank) and sent to users apart from the card. After the user initiates a financial transaction at a processing terminal and enters the PIN, the PIN and transaction related information may be transmitted to the card issuer, who subsequently makes the decision whether or not to authorize the transaction. PINs may comprise static PINs that do not change over time or dynamic PINs that change over time (e.g., a new PIN may be used for every transaction). In some cases, two factor authentication requiring both a smart card (i.e., the "what you have" factor) and a valid PIN (i.e., the "what you know" factor) must be satisfied for a transaction to be approved.

Many banking customers in the United States use a banking card with a magnetic stripe that encodes card related information such as the card holder's name, the expiration date for the card, an account number associated with the card, and card verification information. Outside the United States, the use of smart cards is widely used to provide improved security with financial transactions. Smart cards include an embedded integrated circuit for performing identification, authentication, data storage, and application processing. One standard for using smart cards to authenticate credit and debit card transactions is the EMV standard. EMV chip card transactions may improve security against card fraud as compared with magnetic stripe card transactions since cryptographic algorithms (e.g., DES and RSA) may be used to provide authentication of the card to the processing terminal and/or the card issuer's authentication system.

BRIEF SUMMARY

According to one aspect of the present disclosure, technology for securing financial transactions and preventing card skimming is disclosed.

Technology is described for securing financial transactions using dynamic PINs without requiring updates to existing banking cards or existing infrastructure at acquiring institutions. As an example, ATMs, POS terminals, servers, and hardware security modules associated with acquiring institutions do not need to be replaced or updated in order to use dynamic PINs for authorizing financial transactions. However, the ability to incorporate dynamic PINs with card authorization may require updates to infrastructure at an issuing institution, such as the creation of a new zone or a software update for handling the dynamic PINs at the issuing institution. In some embodiments, the use of a dynamic PIN may be selectively enabled for a subset of banking cards or for a particular banking card when circumstances require use of the dynamic PIN. In one example, a dynamic PIN may be required for performing a financial transaction (e.g., making an online purchase or withdrawing money from an ATM) if an account associated with a banking card has a particular credit limit greater than a threshold or if a suspicious transaction history has been detected (e.g., large out-of-state purchases have recently been made). In another example, a dynamic PIN may be required based on a time of day or location associated with the financial transaction (e.g., if the financial transaction is being initiated within a particular foreign country).

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the Background.

BRIEF DESCRIPTION OF THE DRAWINGS

Aspects of the present disclosure are illustrated by way of example and are not limited by the accompanying figures with like references indicating like elements.

DETAILED DESCRIPTION

Figure 1:
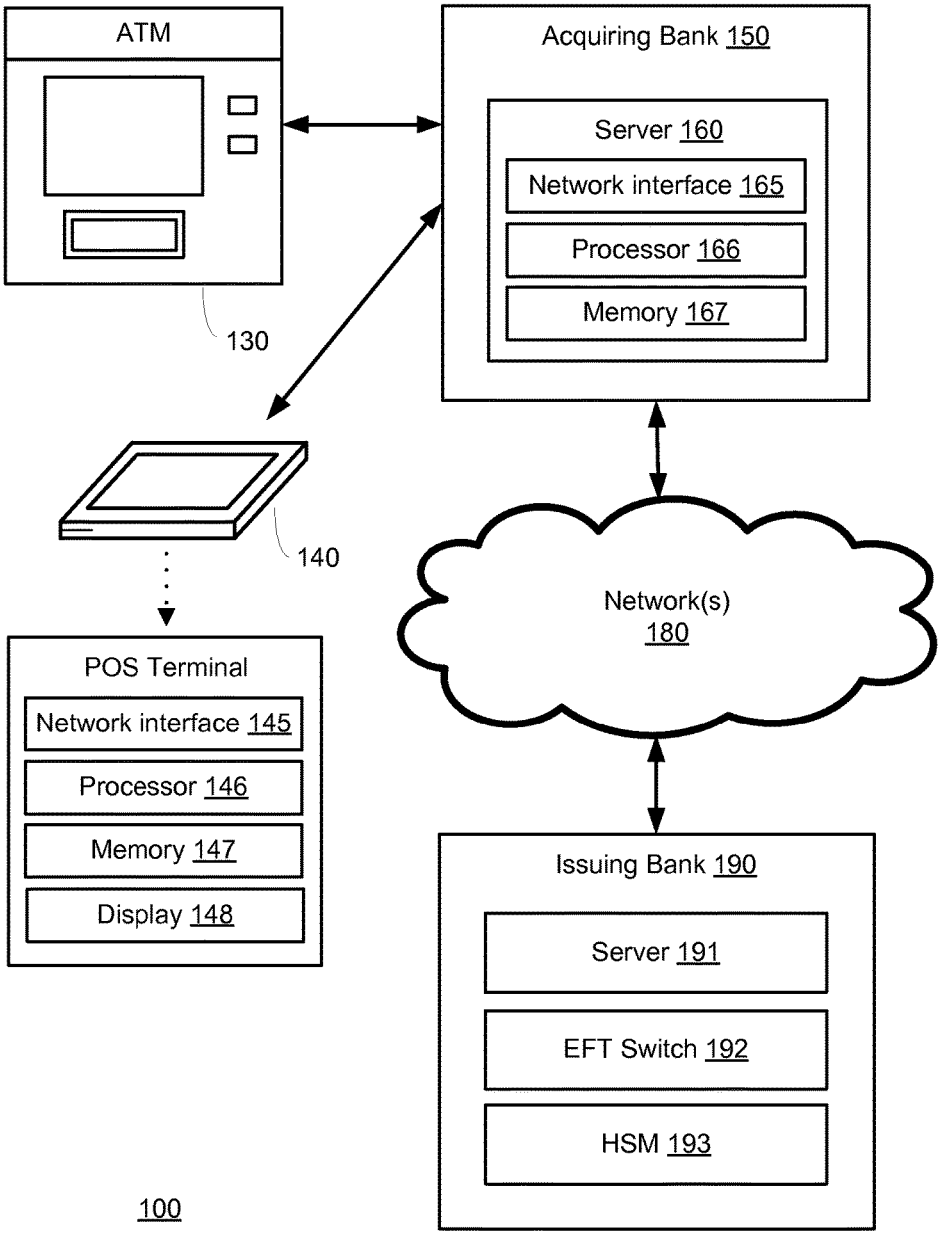
FIG. 1 depicts one embodiment of a card authorization environment in which the disclosed technology may be practiced.

As will be appreciated by one skilled in the art, aspects of the present disclosure may be illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, microcode, etc.) or combining software and hardware implementation that may all generally be referred to herein as a "circuit," "module," "component," or "system." Furthermore, aspects of the present disclosure may take the form of a computer program product embodied in one or more computer readable media having computer readable program code embodied thereon.

Any combination of one or more computer readable media may be utilized. The computer readable media may be a computer readable signal medium or a computer readable storage medium. A computer readable storage medium may be, for example, but not limited to, an electronic, magnetic, optical, electromagnetic, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), an appropriate optical fiber with a repeater, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, CII, VB.NET or the like, conventional procedural programming languages, such as the "C" programming language, Visual Basic, Fortran 2003, Perl, Python, COBOL 2002, PHP, ABAP, dynamic programming languages such as Python, Ruby and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Aspects of the present disclosure are described herein with reference to flowchart illustrations and/or block diagrams of methods, apparatuses (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable instruction execution apparatus, create a mechanism for implementing the functions/acts specified in the flowchart and/or block diagram block or blocks.

These computer program instructions may also be stored in a computer readable medium that when executed can direct a computer, other programmable data processing apparatus, or other devices to function in a particular manner, such that the instructions when stored in the computer readable medium produce an article of manufacture including instructions which when executed, cause a computer to implement the function/act specified in the flowchart and/or block diagram block or blocks. The computer program instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions/acts specified in the flowchart and/or block diagram block or blocks.

Technology is described for securing financial transactions using dynamic PINs without requiring updates to existing banking cards or existing infrastructure at acquiring institutions (e.g., ATMs, POS terminals, servers, and hardware security modules associated with acquiring institutions do not need to be replaced or updated). The ability to incorporate dynamic PINs with card authorization may require updates to infrastructure at an issuing institution, such as the creation of a new zone or a software update for handling the dynamic PINs at the issuing institution. In some embodiments, the use of a dynamic PIN may be selectively enabled for a subset of banking cards or for a particular banking card when circumstances require use of the dynamic PIN. In one example, a dynamic PIN may be required for performing a financial transaction (e.g., making an online purchase or withdrawing money from an ATM) if an account associated with a banking card has a particular credit limit greater than a threshold or if a suspicious transaction history has been detected (e.g., large out-of-state purchases have recently been made). In another example, a dynamic PIN may be required based on a time of day or location associated with the financial transaction (e.g., if the financial transaction is being initiated within a particular foreign country or outside of a particular region in which a user typically performs financial transactions).

The cost to update the infrastructure necessary to adopt the EMV standard in the United States and incorporate the use of smart cards for authorizing financial transactions is estimated by some to be billions of dollars. The infrastructure updates may include replacing banking cards (or payment cards) and updating ATMs and POS terminals. However, even if the infrastructure is updated to accommodate smart cards, the use of smart cards may not improve the security of online purchases. Thus, there is a need to improve the security of financial transactions (including online purchases) without requiring significant updates to the existing authorization infrastructure.

Moreover, with smart cards (e.g., the EMV smartcard approach), it is the card factor that is protected (i.e., a smart card is difficult to clone). In the case of dynamic PINs, banking cards need not be updated as a PIN protects the "what you know" authentication factor. Thus, the EMV smartcard approach may require updates to an entire payment ecosystem including ATMs and POS terminals in different countries as well as updated banking cards, whereas a dynamic PIN based approach does not require updates to ATMs and POS terminals or existing banking cards.

In some embodiments, a user of a banking card may initiate a financial transaction at a card processing terminal. The financial transaction may comprise the withdrawing of money from an ATM or the authorizing of an online purchase or other card-not-present transaction. The banking card may comprise a credit card, debit card, or other card including information for authorizing a financial transaction. Prior to the initiation of the financial transaction, the card issuer of the banking card may determine a first set of users to which static PINs apply and a second set of users to which dynamic PINs apply. The card issuer may also enable the use of dynamic PINs on a per card basis. For example, dynamic PINs may be required to authorize card-based transactions associated with specific banking accounts. If the financial transaction requires a dynamic PIN in order to authorize the financial transaction (i.e., the user of the banking card is one of the first set of users), then the user may obtain the dynamic PIN from a mobile device associated with the user (e.g., a mobile phone used by the user). In one example, the mobile device may include an application for generating the dynamic PIN. In some cases, the application may generate the dynamic PIN based on a time of day (e.g., a time-based PIN) or a transaction sequence number depending on a number of transactions that have previously occurred (e.g., an event-based PIN). In another example, the dynamic PIN may be transmitted to the mobile device via an email message or text message (e.g., an SMS message). Once the dynamic PIN has been obtained by the user and entered into a card processing terminal, then the card issuer may authorize the financial transaction by either comparing the dynamic PIN or an encrypted version of the dynamic PIN.

In some embodiments, the dynamic PIN may comprise a numeric value. In some embodiments, rather than using a PIN (number), a dynamically generated alphanumeric code may be used for providing the "what you know" authentication factor. In one example, the alphanumeric code may be entered into a card processing terminal using a touch-screen alphanumeric keypad or a telephone-style keypad. An alphanumeric code may also be entered into a card processing terminal using voice and speech recognition techniques. For example, the card processing terminal may identify a person associated with a banking card based on the customer's voice and the customer may enter a PIN into the card processing terminal using voice commands. In other embodiments, the alphanumeric code to be entered may comprise the answer to a dynamically generated challenge question or a dynamically generated personal knowledge question that has been transmitted to the card user's mobile device (e.g., what is the card user's favorite sport or sports team).

FIG. 1 depicts one embodiment of a card authorization environment 100 in which the disclosed technology may be practiced. Card authorization environment 100 includes one or more card processing terminals, such as ATM 130 (i.e., an automated teller machine) and POS terminal 140, in communication with an acquiring bank 150. The acquiring bank 150 is in communication with an issuing bank 190 via one or more networks 180. In some cases, the acquiring bank 150 may communicate with the issuing bank 190 via an intermediary payment network (e.g., a network associated with a credit card company). The POS terminal 140 may comprise a mobile device for facilitating a retail transaction or other financial transaction, such as a tablet computer with a card reader interface. The POS terminal may utilize a camera or light sensor for reading information from a banking card. The POS terminal 140 includes a network interface 145, a processor 146, a memory 147, and a display 148 all in communication with each other. Network interface 145 allows POS terminal 140 to communicate with a server or other computers associated with the acquiring bank 150. Network interface 145 may include a wireless network interface, a modem, and/or a wired network interface. Processor 146 allows POS terminal 140 to execute computer readable instructions stored in memory 147 in order to perform processes discussed herein.

The acquiring bank 150 may include a server 160 for processing card transactions and communicating with an issuing bank, such as issuing bank 190. The server 160 includes a network interface 165, a processor 166, and a memory 167 all in communication with each other. Network interface 165 allows server 160 to communicate with card processing terminals and/or one or more networks 180. Processor 166 allows server 160 to execute computer readable instructions stored in memory 167 in order to perform processes discussed herein. The one or more networks 180 may include a secure network such as an enterprise private network, an unsecure network such as a wireless open network, a local area network (LAN), a wide area network (WAN), and the Internet. Each network of the one or more networks 180 may include hubs, bridges, routers, switches, and wired transmission media such as a wired network or direct-wired connection.

The issuing bank 190 includes server 191, electronic funds transfer (EFT) switch 192, and hardware security module (HSM) 193, all in communication with each other. The server 191, EFT switch 192, and HSM 193 may be part of an authentication system associated with the issuing bank 190. In some cases, a hardware security module may also be referred to as a host security module. HSM 193 may comprise a tamper-resistant peripheral device that provides cryptographic processing without revealing decrypted data and key management. The HSM 193 may utilize asymmetric cryptographic algorithms (e.g., RSA) or symmetric cryptographic algorithms (e.g., DES or 3DES). The HSM 193 may perform PIN generation, PIN block translation (e.g., translating a PIN block from encryption under a first key to encryption under a second key), PIN verification, PIN encryption, and/or message authentication on behalf of a host computer, such as server 191. The server 191 may send commands to the HSM 193 (e.g., to verify a PIN) and receive a response from the HSM 193 (e.g., that the PIN is valid for a particular account). In some cases, each command and response may include a variable number of fields sent via a serial data link or network using variety of protocols including TCP/IP and UDP. A PIN block may comprise a cryptogram associated with a PIN (e.g., an encrypted PIN block corresponding with a dynamic PIN entered by a user at an ATM machine). The HSM 193 may compare a PIN block generated from a dynamic PIN entered at a card processing terminal with an encrypted PIN block stored within the HSM 193. The HSM 193 may also re-encrypt a given PIN block and transfer it to server 191 for comparison with another encrypted PIN block.

HSM 193 may support the use of different types of cryptographic keys. In one example, the HSM 193 may support a Zone Master Key (ZMK) or key-encrypting key (KEK). The ZMK may be used for transporting or sharing keys between zones within a network (e.g., for transmitting data between an acquiring bank and an issuing bank). The ZMK may also be used as a wrapper to ensure that keys are not compromised during the transfer process from one computer to another. In another example, the HSM 193 may support a Local Master Key (LMK). The LMK may be stored in a secure memory of HSM 193. In some cases, all other keys and secret data may be encrypted under the LMK (or set of LMKs) for local storage within the HSM 193. In another example, the HSM 193 may support a Zone PIN Key (ZPK). The ZPK may be used to encrypt data, such as PINs, for transfer between parties, such as an acquiring bank and an issuing bank. The HSM 193 may also utilize a PIN Verification Key (PVK) for generating and verifying a PIN.

In general, a server, such as server 160 or server 191, may allow a client to download information from the server in response to an authorized financial transaction or to perform a search query related to particular financial information stored on the server. In general, a "server" may include a hardware device that acts as the host in a client-server relationship or a software process that shares a resource with or performs work for one or more clients. Communication between computing devices in a client-server relationship may be initiated by a client sending a request to the server asking for access to a particular resource or for particular work to be performed. The server may subsequently perform the actions requested and send a response back to the client.

Card authorization environment 100 may comprise a cloud computing environment. Cloud computing refers to Internet-based computing, wherein shared resources, software, and/or information are provided to one or more computing devices on-demand via the Internet (or other global network). The term "cloud" is used as a metaphor for the Internet, based on the cloud drawings used in computer networking diagrams to depict the Internet as an abstraction of the underlying infrastructure it represents.

In one embodiment, the server 191 includes a network interface 195, a processor 196, and a memory 197 all in communication with each other. Network interface 195 allows server 191 to communicate with another server, such as server 160, and/or one or more networks 180. Processor 196 allows server 191 to execute computer readable instructions stored in memory 197 in order to perform processes discussed herein.

In one embodiment, a card-based financial transaction may be initiated at a card processing terminal, such as POS terminal 140 or ATM 130. Transaction data such as card-related information related to the card used for initiating the financial transaction and transaction-related information related to the financial transaction itself may be transmitted from the card processing terminal to a server, such as server 160, associated with an acquiring bank. The server at the acquiring bank may communicate with an authentication system associated with an issuing bank (e.g., via one or more networks 180) in order to authorize the card-based financial transaction based on the transaction data. The transaction data may include information derived from the card (e.g., an account number), the terminal (e.g., a merchant identifier), the transaction (e.g., an amount associated with the transaction), and a static or dynamic PIN associated with the card. The card issuer's authentication system may authorize or decline the financial transaction and generate a response message which is transmitted back to the card processing terminal. In some cases, ISO 8583 may be used to define a message format for communicating with various systems within the card authorization environment 100.

In one embodiment, a card authorization environment 100 may authorize a particular financial transaction based on the entry of a valid static PIN unless the financial transaction has been initiated outside of a particular region in which a card user typically performs financial transactions (e.g., is outside a 50 mile radius of the card user's home location) or the financial transaction exceeds a particular dollar amount (e.g., a purchase of goods that exceeds $500). In some embodiments, the use of a dynamic PIN may be selectively enabled for a subset of banking cards or for a particular banking card when circumstances require use of the dynamic PIN. In one example, a dynamic PIN may be required for performing a financial transaction if an account associated with a banking card has a particular credit limit greater than a threshold (e.g., for credit cards with credit limits that exceed $15,000) or if a suspicious transaction history has been detected (e.g., a large out-of-state purchase have recently been made).

Figure 2:
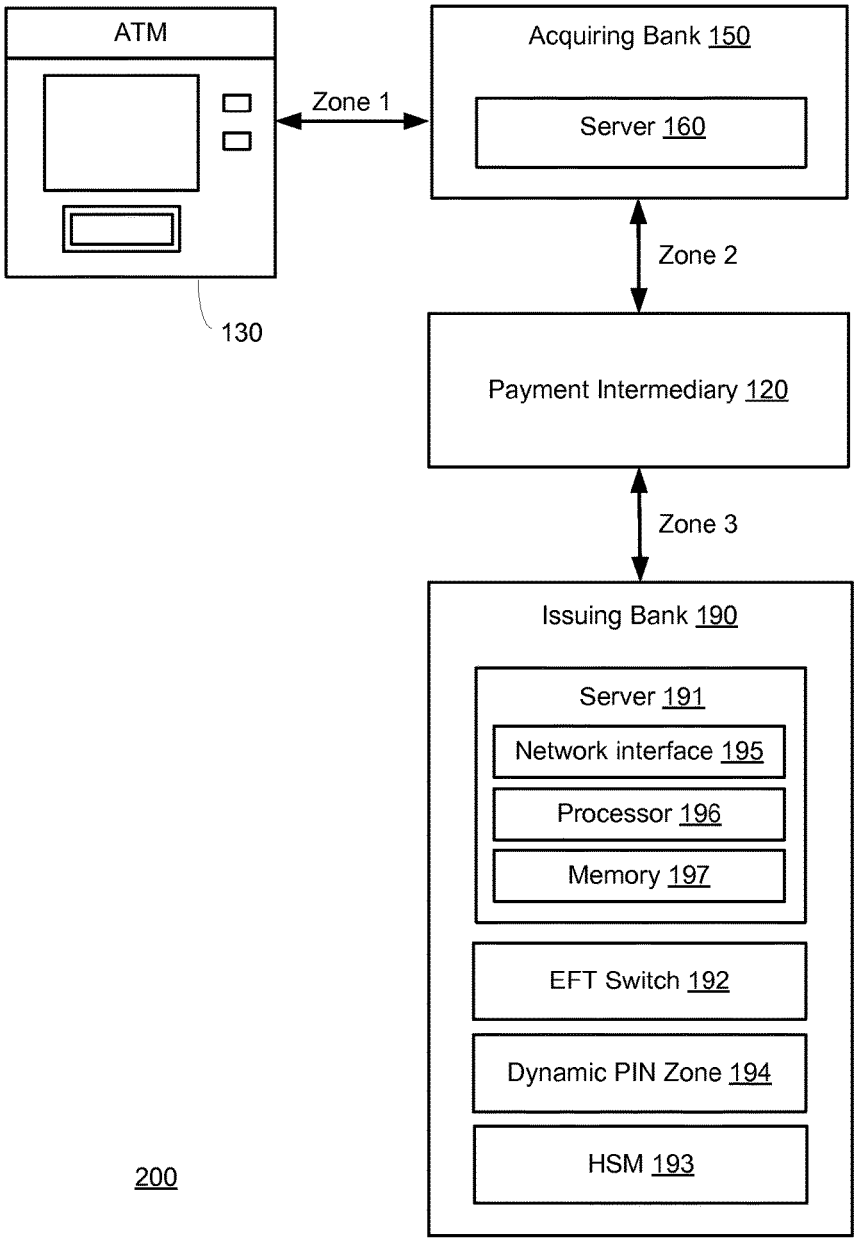
FIG. 2 depicts one embodiment of a card authorization environment in which the disclosed technology may be practiced.

FIG. 2 depicts one embodiment of a card authorization environment 200 in which the disclosed technology may be practiced. Card authorization environment 200 may include one or more card processing terminals, such as ATM 130, in communication with an acquiring bank 150. The acquiring bank 150 is in communication with an issuing bank 190 via a payment intermediary 120. In one embodiment, the payment intermediary 120 may correspond with a payment network associated with a credit card company. As depicted, a first zone (Zone 1) is established between a card processing terminal and the acquiring bank 150, a second zone (Zone 2) is established between the acquiring bank 150 and the payment intermediary 120, and a third zone (Zone 3) is established between the payment intermediary 120 and the issuing bank 190. In some embodiments, a PIN entered into the card processing terminal may be encrypted using a first key associated with the first zone for transmission within the first zone, encrypted using a second key associated with the second zone for transmission within the second zone, and encrypted using a third key associated with the third zone for transmission within the third zone.

In some embodiments, the card authorization environment 200 may authorize a particular financial transaction using a dynamic PIN entered into a card processing terminal. The dynamic PIN may be encrypted at the card processing terminal and eventually transferred to the issuing bank 190 for authorization. The issuing bank 190 may authorize the financial transaction using an authentication system including server 191, EFT switch 192, and HSM 193. In some cases, the server 191 may map static PINs stored within the HSM 193 to corresponding dynamic PINs using the static PINs as seeds. In one embodiment, a static PIN associated with a particular banking account may be used as a seed for generating a time-based dynamic PIN or an event-based dynamic PIN. For example, an event-based dynamic PIN may comprise a static PIN value plus a number (or multiple thereof) corresponding with the number of transactions that have previously been authorized for the particular banking account.

In one embodiment, server 191 may compare an encrypted version of the dynamic PIN entered at the card processing terminal with an encrypted PIN stored within HSM 193. If the encrypted version of the dynamic PIN entered at the card processing terminal matches the encrypted PIN stored within HSM 193, then a financial transaction may be authorized. In this case, the server 191 may request the encrypted PIN stored within HSM 193 based on a banking account associated with the financial transaction. The server 191 may utilize card-related information and/or transaction-related information in order send commands to the HSM 193 to acquire the appropriate encrypted PIN from the HSM 193. In some cases, software running inside the EFT switch may be used to perform the dynamic PIN comparison.

In another embodiment, a dynamic PIN zone 194 may be added at the issuing bank 190 in order to authorize the dynamic PIN entered at the card processing terminal. The dynamic PIN zone 194 may correspond with a second HSM. The second HSM may internally compare the dynamic PIN entered at the card processing terminal with a decrypted version of an encrypted PIN stored within the HSM 193. If the second HSM associated with the dynamic PIN zone 194 outputs a valid match, then a financial transaction may be authorized. The server 191 may utilize card-related information and/or transaction-related information in order send commands to the HSM 193 to acquire the appropriate encrypted PIN from the HSM 193 to be used by the second HSM associated with the dynamic PIN zone 194. In some cases, the server 191 may manage the authorization of the financial transaction based on responses provided by the second HSM associated with the dynamic PIN zone 194. In other cases, software running inside the EFT switch may be used to manage the authorization of the financial transaction using the second HSM.

In one embodiment, a card issuer's authentication system may parse a message including an incoming PIN block and use HSM PIN translation functions to translate the PIN block to a key associated with the dynamic PIN zone 194. An HSM associated with the dynamic PIN zone 194 may decrypt the PIN block and send the decrypted PIN (e.g., a plain text PIN) to server 191 for authorization.

Figure 3:
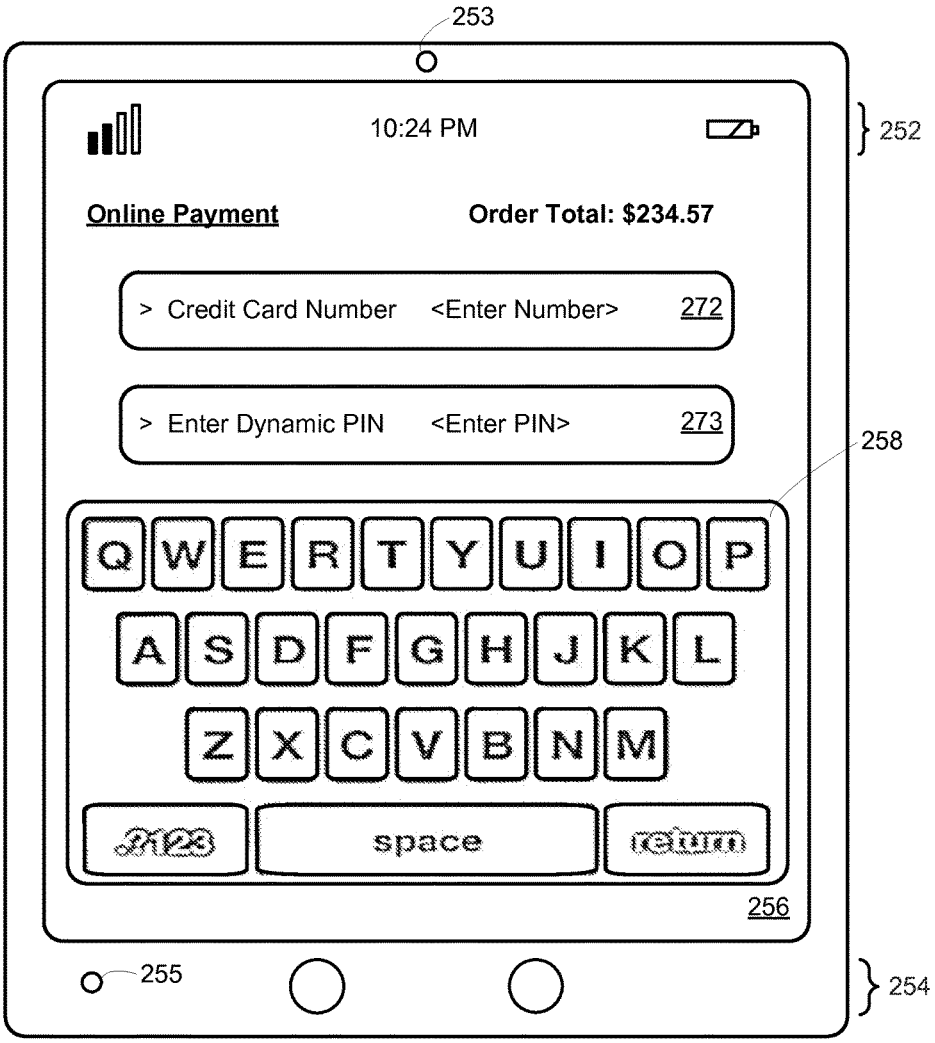
FIG. 3 depicts one embodiment of a mobile device that may be used for initiating a financial transaction.

FIG. 3 depicts one embodiment of a mobile device 141 that may be used for initiating a financial transaction. The mobile device 141 may comprise a card processing terminal in communication with an acquiring institution. The mobile device 141 may be running an online payment application or be connected to a web-based online payment application (e.g., via a web browser). As depicted, mobile device 141 includes a touchscreen display 256, physical control buttons 254, a microphone 255, and a front-facing camera 253. The touchscreen display 256 may include an LCD display for presenting a user interface to an end user of the mobile device. The touchscreen display 256 may include a status area 252 which provides information regarding signal strength, time, and battery life associated with the mobile device. In some embodiments, the mobile device may determine a particular location of the mobile device (e.g., via GPS coordinates). The microphone 255 may capture audio associated with the end user (e.g., the end user's voice) for determining the identity of the end user. The front-facing camera 253 may be used to capture images of the end user for determining the identity of the end user. The online payment application may utilize a virtual keyboard 258 for data entry, such as the entry of a dynamic PIN required for authorizing a financial transaction. The virtual keyboard application 258 may be invoked automatically by the application or by selection by an end user of a particular entry field of the application.

In one embodiment, an end user of the mobile device 141 may initiate a financial transaction (e.g., making an online purchase for goods totaling $234.57) by entering credit card information into the credit card number field 272 and a dynamic PIN into the dynamic PIN field 273. In some cases, the mobile device 141 may automatically generate and fill (i.e., fill in the dynamic PIN field 273 without requiring actions to be performed by the end user) the dynamic PIN associated with the financial transaction using a time-based dynamic PIN generator or an event-based dynamic PIN generator. In one embodiment, the mobile device 141 may automatically generate and fill the dynamic PIN based on an email message or text message received by the mobile device. In some cases, the mobile device 141 may automatically fill in the dynamic PIN field 273 with a static PIN if the mobile device 141 is within a first country or county and fill in a dynamic PIN if the mobile device 141 is outside the first country or county.

Figure 4A:
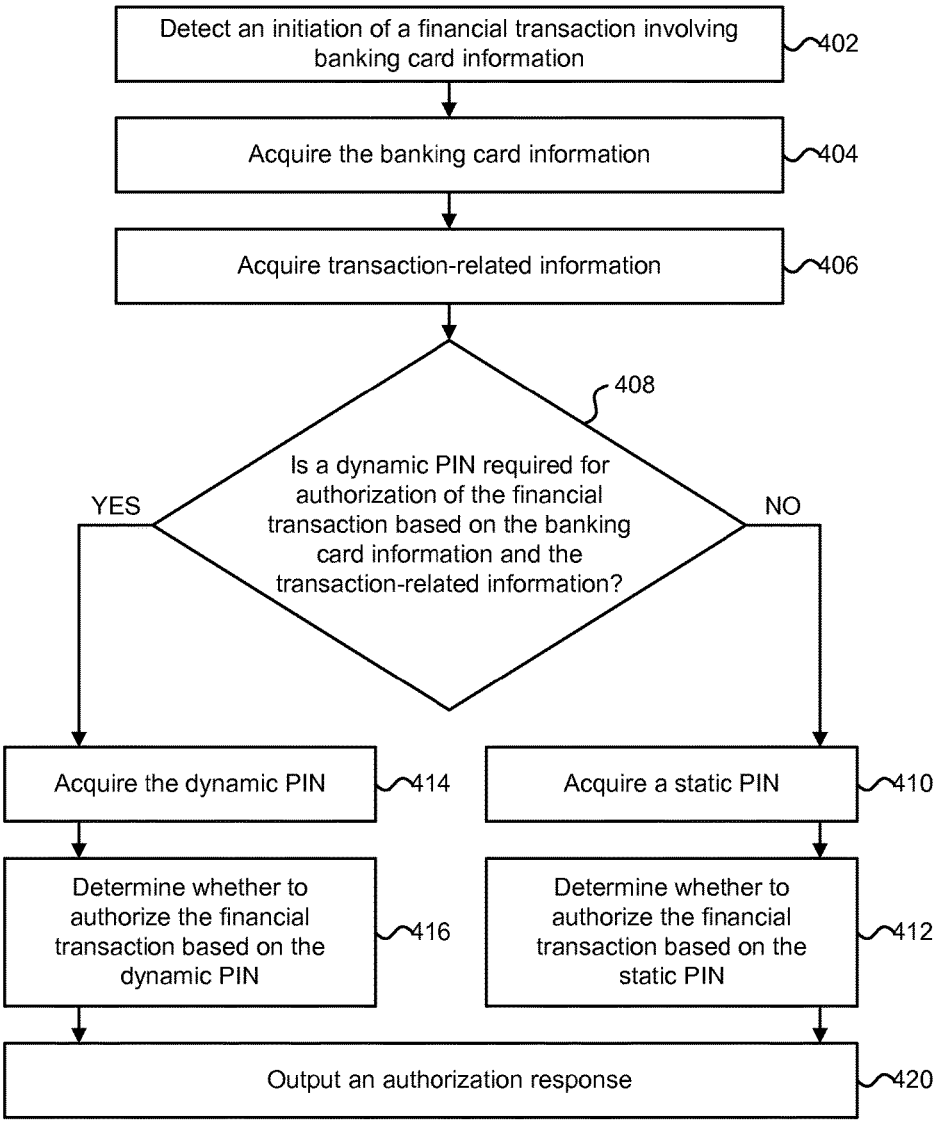
FIG. 4A is a flowchart describing one embodiment of a process for authorizing a financial transaction using a dynamic PIN.

FIG. 4A is a flowchart describing one embodiment of a process for authorizing a financial transaction using a dynamic PIN. In one embodiment, the process of FIG. 4A is performed by an authentication system associated with an issuing bank, such as issuing bank 190 in FIG. 2. In some cases, the process of FIG. 4A may be performed by a server, such as server 191 in FIG. 2.

In step 402, an initiation of a financial transaction involving banking card information is detected. In one example, the financial transaction may comprise a purchase of goods at a retail store or an online purchase. In step 404, the banking card information is acquired. The banking card information may include an account number associated with the financial transaction. In step 406, transaction-related information is acquired. The transaction-related information may include a merchant identifier (e.g., an identification of the business from which goods are being purchased) and a transaction amount (e.g., the cost of the goods being purchased).

In step 408, it is determined whether a dynamic PIN is required to authorize the financial transaction based on the banking card information and the transaction-related information. If it is determined that a dynamic PIN is required, then step 414 is performed. Otherwise, if a dynamic PIN is not required, in step 410 is performed. One embodiment of a process for determining whether a dynamic PIN is required for authorizing a financial transaction is described later in reference to FIG. 4B. In some embodiments, the decision of whether a dynamic PIN or a static PIN is required to authorize a financial transaction may be determined by an issuing bank or by servers associated with the issuing bank.

In step 410, a static PIN is acquired. The static PIN may be acquired from a card processing terminal or an acquiring bank, such as acquiring bank 150 in FIG. 2. In step 412, it is determined whether to authorize the financial transaction based on the static PIN. In one embodiment, the static PIN may be compared with one or more PINs stored within an HSM associated with an issuing bank, such as HSM 193 in FIG. 2.

In step 414, the dynamic PIN is acquired. The dynamic PIN may be acquired from a card processing terminal or an acquiring bank, such as acquiring bank 150 in FIG. 2. In step 416, it is determined whether to authorize the financial transaction based on the dynamic PIN. In one embodiment, the dynamic PIN may be compared with one or more PINs stored within an HSM associated with an issuing bank, such as HSM 193 in FIG. 2. In some cases, the dynamic PIN may be encrypted and then compared with a corresponding encrypted PIN stored within an HSM associated with an issuing bank, such as HSM 193 in FIG. 2. The comparison of encrypted dynamic PINs may be performed by a server, such as server 191 in FIG. 2, or by software running on an EFT switch, such as EFT switch 192 in FIG. 2. In another embodiment, the dynamic PIN may be compared using a second HSM associated with a dynamic PIN zone used within an issuing bank, such as dynamic PIN zone 194 in FIG. 2. In step 420, an authorization response is outputted. In one embodiment, the issuing bank or an authentication system of the issuing bank may transmit the authorization response (e.g., whether the financial transaction has been approved or has not been approved) to an acquiring bank or to a card processing terminal.

In some cases, to compensate for clock skew or time delays in authorization processing, a dynamic PIN entered at a card processing terminal may be compared with a plurality of PINs associated with a particular window of time in order to determine whether a financial transaction should be authorized.

Figure 4B:
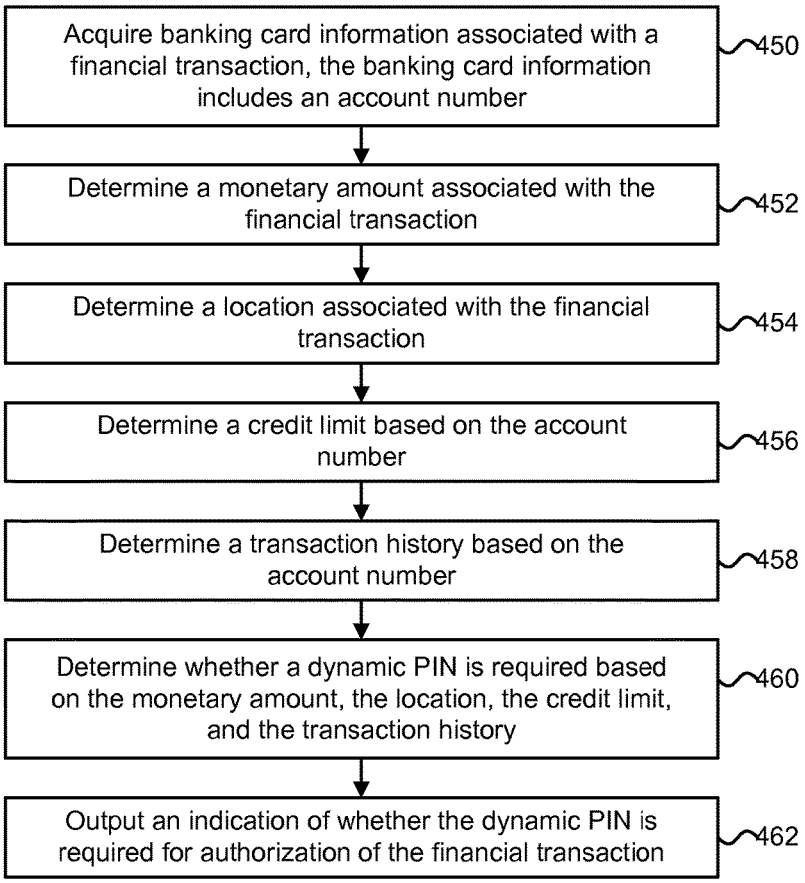
FIG. 4B is a flowchart describing one embodiment of a process for determining whether a dynamic PIN is required for authorizing a financial transaction.

FIG. 4B is a flowchart describing one embodiment of a process for determining whether a dynamic PIN is required for authorizing a financial transaction. The process described in FIG. 4B is one example of a process for implementing step 408 in FIG. 4A. In one embodiment, the process of FIG. 4B is performed by an authentication system associated with an issuing bank, such as issuing bank 190 in FIG. 2. In another embodiment, the process of FIG. 4B is performed by a server, such as server 191 in FIG. 2.

In step 450, banking card information associated with a financial transaction is acquired. The banking card information may include an account number corresponding with a banking card. In step 452, a monetary amount associated with the financial transaction is determined. In step 454, a location associated with the financial transaction is determined. The location may correspond with a location of a card processing terminal or the location of a mobile device used for initiating the financial transaction (e.g., based on a GPS location of the mobile device). In step 456, a credit limit is determined based on the account number. In step 458, a transaction history is determined based on the account number. In step 460, it is determined whether a dynamic PIN is required based on the monetary amount, the location, the credit limit, and the transaction history. In step 462, an indication of whether the dynamic PIN is required for authorization of the financial transaction is outputted. The indication may be outputted to a server, such as server 191 in FIG. 2.

In some embodiments, a dynamic PIN may be required for authorization of the financial transaction if the location is outside of a particular region in which a card user typically performs financial transactions, if the location corresponds with a particular foreign country, or if the monetary amount exceeds a particular dollar amount.

One embodiment of the disclosed technology includes detecting an initiation of a financial transaction involving banking card information, acquiring the banking card information in response to the detecting an initiation of the financial transaction, acquiring transaction-related information associated with the financial transaction, determining whether a dynamic code is required for authorization of the financial transaction based on the banking card information and the transaction-related information, acquiring the dynamic code, determining whether to authorize the financial transaction based on the dynamic code, and outputting an authorization response subsequent to the determining whether to authorize the financial transaction based on the dynamic code.

One embodiment of the disclosed technology includes a processor in communication with a storage device. The storage device stores banking card information associated with an initiation of a financial transaction and transaction-related information associated with the financial transaction. The processor determines whether a dynamic code is required for authorization of the financial transaction based on the banking card information and the transaction-related information. The processor acquires the dynamic code and determines whether to authorize the financial transaction based on the dynamic code. The processor outputs an authorization response subsequent to determining whether to authorize the financial transaction based on the dynamic code.

One embodiment comprises a computer program product comprising a computer readable storage medium having computer readable program code embodied therewith. The computer readable program code configured to detect an initiation of a financial transaction involving banking card information, acquire the banking card information in response to detecting the initiation of the financial transaction, acquire transaction-related information associated with the financial transaction, determine whether a dynamic PIN is required for authorization of the financial transaction based on the banking card information and the transaction-related information, acquire the dynamic PIN, determine whether to authorize the financial transaction based on the dynamic PIN, and output an authorization response in response determining that the financial transaction has been authorized.

Figure 5:
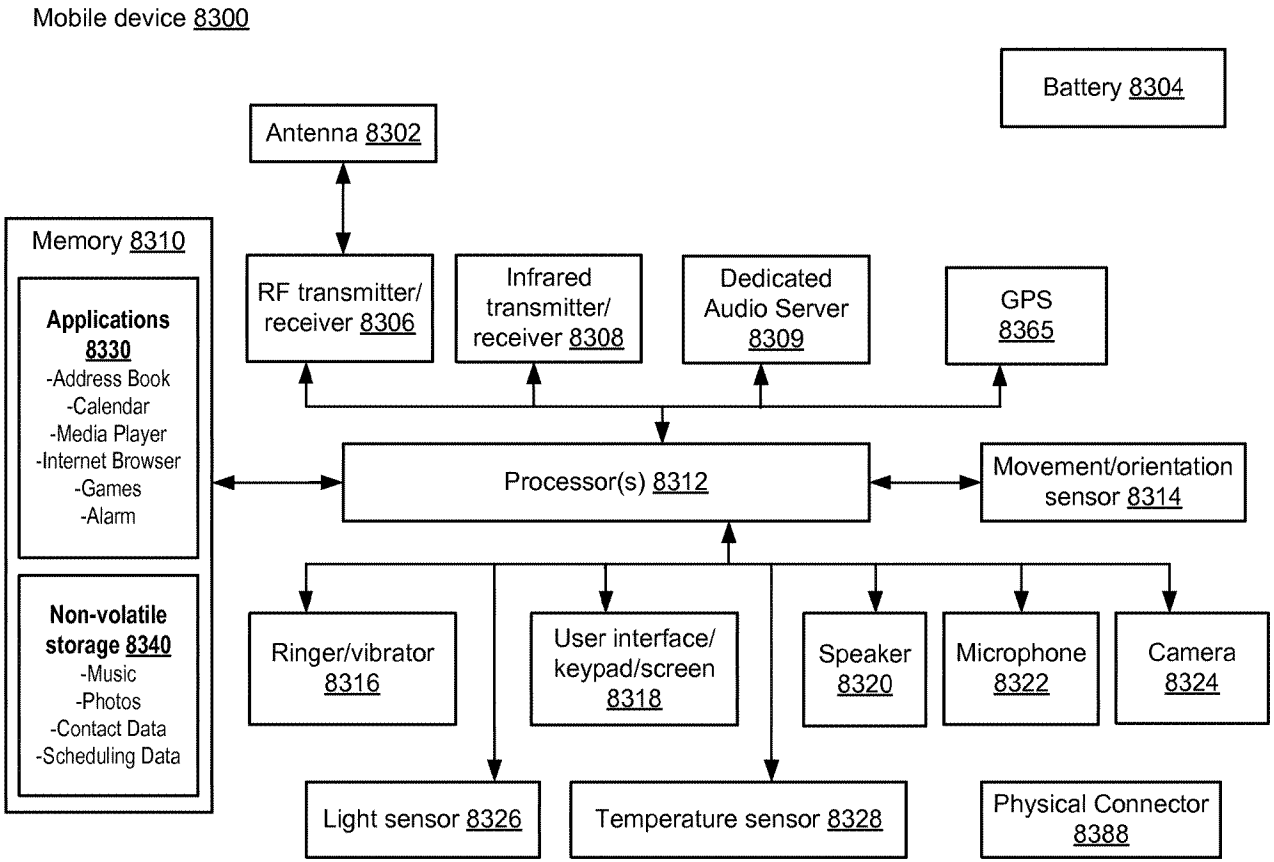
FIG. 5 depicts one embodiment of a mobile device for initiating a financial transaction.

The disclosed technology may be used with various computing systems. FIG. 5 depicts one embodiment of a mobile device 8300, which includes one example of a mobile implementation for POS terminal 140 in FIG. 1. Mobile devices may include laptop computers, pocket computers, mobile phones, personal digital assistants, tablet computers, and handheld media devices that have been integrated with wireless receiver/transmitter technology.

Mobile device 8300 includes one or more processors 8312 and memory 8310. Memory 8310 includes applications 8330 and non-volatile storage 8340. Memory 8310 can be any variety of memory storage media types, including non-volatile and volatile memory. A mobile device operating system handles the different operations of the mobile device 8300 and may contain user interfaces for operations, such as placing and receiving phone calls, text messaging, checking voicemail, and the like. The applications 8330 can be any assortment of programs, such as a camera application for photos and/or videos, an address book, a calendar application, a media player, an internet browser, games, an alarm application, and other applications. The non-volatile storage component 8340 in memory 8310 may contain data such as music, photos, contact data, scheduling data, and other files.

The one or more processors 8312 also communicates with dedicated audio server 8309, with RF transmitter/receiver 8306 which in turn is coupled to an antenna 8302, with infrared transmitter/receiver 8308, with global positioning service (GPS) receiver 8365, and with movement/orientation sensor 8314 which may include an accelerometer and/or magnetometer. RF transmitter/receiver 8308 may enable wireless communication via various wireless technology standards such as Bluetooth® or the IEEE 802.11 standards. Accelerometers have been incorporated into mobile devices to enable applications such as intelligent user interface applications that let users input commands through gestures, and orientation applications which can automatically change the display from portrait to landscape when the mobile device is rotated. An accelerometer can be provided, e.g., by a micro-electromechanical system (MEMS) which is a tiny mechanical device (of micrometer dimensions) built onto a semiconductor chip. Acceleration direction, as well as orientation, vibration, and shock can be sensed. The one or more processors 8312 further communicate with a ringer/vibrator 8316, a user interface keypad/screen 8318, a speaker 8320, a microphone 8322, a camera 8324, a light sensor 8326, and a temperature sensor 8328. The user interface keypad/screen may include a touch-sensitive screen display.

The one or more processors 8312 controls transmission and reception of wireless signals. During a transmission mode, the one or more processors 8312 provide voice signals from microphone 8322, or other data signals, to the RF transmitter/receiver 8306. The transmitter/receiver 8306 transmits the signals through the antenna 8302. The ringer/vibrator 8316 is used to signal an incoming call, text message, calendar reminder, alarm clock reminder, or other notification to the user. During a receiving mode, the RF transmitter/receiver 8306 receives a voice signal or data signal from a remote station through the antenna 8302. A received voice signal is provided to the speaker 8320 while other received data signals are processed appropriately.

Additionally, a physical connector 8388 may be used to connect the mobile device 8300 to an external power source, such as an AC adapter or powered docking station, in order to recharge battery 8304. The physical connector 8388 may also be used as a data connection to an external computing device. For example, the data connection may allow for operations such as synchronizing mobile device data with the computing data on another device.

The flowchart and block diagrams in the Figures illustrate the architecture, functionality, and operation of possible implementations of systems, methods and computer program products according to various aspects of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular aspects only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of any means or step plus function elements in the claims below are intended to include any disclosed structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The aspects of the disclosure herein were chosen and described in order to best explain the principles of the disclosure and the practical application, and to enable others of ordinary skill in the art to understand the disclosure with various modifications as are suited to the particular use contemplated.

For purposes of this document, each process associated with the disclosed technology may be performed continuously and by one or more computing devices. Each step in a process may be performed by the same or different computing devices as those used in other steps, and each step need not necessarily be performed by a single computing device.

For purposes of this document, reference in the specification to "an embodiment," "one embodiment," "some embodiments," or "another embodiment" are used to described different embodiments and do not necessarily refer to the same embodiment.

For purposes of this document, a connection can be a direct connection or an indirect connection (e.g., via another part).

For purposes of this document, the term "set" of objects, refers to a "set" of one or more of the objects.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A method for improving security during authorization of computer transaction, comprising:

detecting an initiation of the computer transaction associated with an end user account from a computing device;

acquiring a location of the computing device initiating the computer transaction and a time of day for the computer transaction in response to detecting the initiation of the computer transaction;

determining whether a dynamic code or a static code is required for authorization of the computer transaction associated with the end user account based on the location of the computing device initiating the computer transaction and the time of day for the computer transaction;

acquiring the dynamic code in response to determining that the dynamic code is required for authorization of the computer transaction; and authorizing the computer transaction associated with the end user account from the computing device based on the dynamic code.

2. The method of claim 1, further comprising:

detecting an initiation of a second computer transaction associated with the end user account from the computing device;

acquiring a second location of the computing device initiating the second computer transaction and a second time of day for the second computer transaction in response to detecting the initiation of the second computer transaction; and detecting that the static code is required for authorization of the second computer transaction associated with the end user account based on the second location of the computing device initiating the second computer transaction and the time of day for the second computer transaction.

3. The method of claim 1, further comprising:

determining whether to authorize the computer transaction based on the dynamic code using an authentication system, the authentication system comprises a PIN zone internal to the authentication system.

4. The method of claim 1, further comprising:

determining whether to authorize the computer transaction based on the dynamic code using an authentication system, the authentication system authorizes the computer transaction based on a comparison of encrypted dynamic PINs.

5. The method of claim 1, wherein:

the dynamic code comprises a dynamic PIN.

6. The method of claim 1, wherein:

the dynamic code comprises an alphanumeric code.

7. The method of claim 1, wherein:

the detecting the initiation of the computer transaction comprises detecting the initiation of the computer transaction by an end user of a mobile device, the mobile device automatically generates the dynamic code.

8. A system for improving security during authorization of a computer transaction, comprising:

a storage device configured to store a location of a computing device initiating the computer transaction and a time of day for the computer transaction; and a processor in communication with the storage device, the processor configured to detect the initiation of the computer transaction associated with an end user account from the computing device, the processor configured to acquire the location of the computing device initiating the computer transaction and the time of day for the computer transaction in response to detecting the initiation of the computer transaction, the processor configured to determine whether a dynamic code or a static code is required for authorization of the computer transaction associated with the end user account based on the location of the computing device initiating the computer transaction and the time of day for the computer transaction, the processor configured to acquire the dynamic code and authorize the computer transaction associated with the end user account from the computing device based on the dynamic code.

9. The system of claim 8, wherein:

the dynamic code comprises a dynamic PIN.

10. The system of claim 8, wherein:

the processor configured to detect an initiation of a second computer transaction associated with the end user account from the computing device, the processor configured to acquire a second location of the computing device initiating the second computer transaction and a second time of day for the second computer transaction in response to detecting the initiation of the second computer transaction, the processor configured to detect that the static code is required for authorization of the second computer transaction associated with the end user account based on the second location of the computing device initiating the second computer transaction and the time of day for the second computer transaction.

11. The system of claim 8, wherein:

the dynamic code comprises an alphanumeric code.

12. A computer program product, comprising:

a non-transitory computer readable storage medium having computer readable program code embodied therewith, the computer readable program code comprising:

computer readable program code configured to detect an initiation of a computer transaction associated with an end user account from a computing device;

computer readable program code configured to acquire a location of the computing device initiating the computer transaction and a time of day for the computer transaction in response to detecting the initiation of the computer transaction;

computer readable program code configured to determine whether a dynamic code or a static code is required for authorization of the computer transaction associated with the end user account based on the location of the computing device initiating the computer transaction and the time of day for the computer transaction;

computer readable program code configured to acquire the dynamic code in response to determining that the dynamic code is required for authorization of the computer transaction;

and computer readable program code configured to authorize the computer transaction associated with the end user account from the computing device based on the dynamic code.

13. The computer program product of claim 12, further comprising:

computer readable program code configured to detect an initiation of a second computer transaction associated with the end user account from the computing device;

computer readable program code configured to acquire a second location of the computing device initiating the second computer transaction and a second time of day for the second computer transaction in response to detecting the initiation of the second computer transaction; and computer readable program code configured to detect that the static code is required for authorization of the second computer transaction associated with the end user account based on the second location of the computing device initiating the second computer transaction and the time of day for the second computer transaction.

14. The computer program product of claim 12, wherein;

the dynamic code comprises a dynamic PIN.

15. The computer program product of claim 14, further comprising:

determining that the dynamic PIN is required if the location corresponds with a particular foreign country.

* * * * *